United States Patent [19]

Walberg

[11] 4,017,029

[45] Apr. 12, 1977

[54] VOLTAGE BLOCK ELECTROSTATIC COATING SYSTEM

[76] Inventor: Arvid C. Walberg, 708 S. Lombard Ave., Lombard, Ill. 60148

[22] Filed: Apr. 21, 1976

[21] Appl. No.: 679,025

[52] U.S. Cl. ..... 239/15; 427/30; 118/629; 239/3

[51] Int. Cl.[2] ..... B06B 5/02

[58] Field of Search ..... 239/3, 15, 124, 127; 427/30–33; 118/627,629; 204/220, 275, 279; 317/3; 222/56, 190

[56] References Cited

UNITED STATES PATENTS

| | | | |
|---|---|---|---|
| 2,692,798 | 10/1954 | Hicks | 239/127 X |
| 3,463,121 | 8/1969 | Walberg | 239/15 X |
| 3,621,815 | 11/1971 | Walberg | 239/15 X |
| 3,637,420 | 1/1972 | Walberg | 427/33 |
| 3,746,253 | 7/1973 | Walberg | 239/3 X |
| 3,774,844 | 11/1973 | Walberg | 239/15 |
| 3,892,357 | 7/1975 | Tamny | 239/15 |
| 3,893,620 | 7/1975 | Rokadia | 239/3 |
| 3,905,550 | 9/1975 | Rokadia et al. | 239/15 |
| 3,929,286 | 12/1975 | Hastings et al. | 239/3 |
| 3,933,285 | 1/1976 | Wiggins | 239/3 X |

FOREIGN PATENTS OR APPLICATIONS

| | | | |
|---|---|---|---|
| 1,444,054 | 5/1966 | France | 239/15 |

*Primary Examiner*—Robert S. Ward, Jr.
*Attorney, Agent, or Firm*—Mason, Albright & Stansbury

[57] ABSTRACT

An electrostatic spray coating system for spraying conductive coatings such as water base paint has a grounded paint supply sub-system which intermittently supplies conductive coating material to a high voltage sub-system across an air space. An interlock system prevents conductive coating material from being transferred from the grounded sub-system to the high voltage sub-system while high voltage electrical potentials being applied to the high voltage coating material sub-system.

10 Claims, 1 Drawing Figure

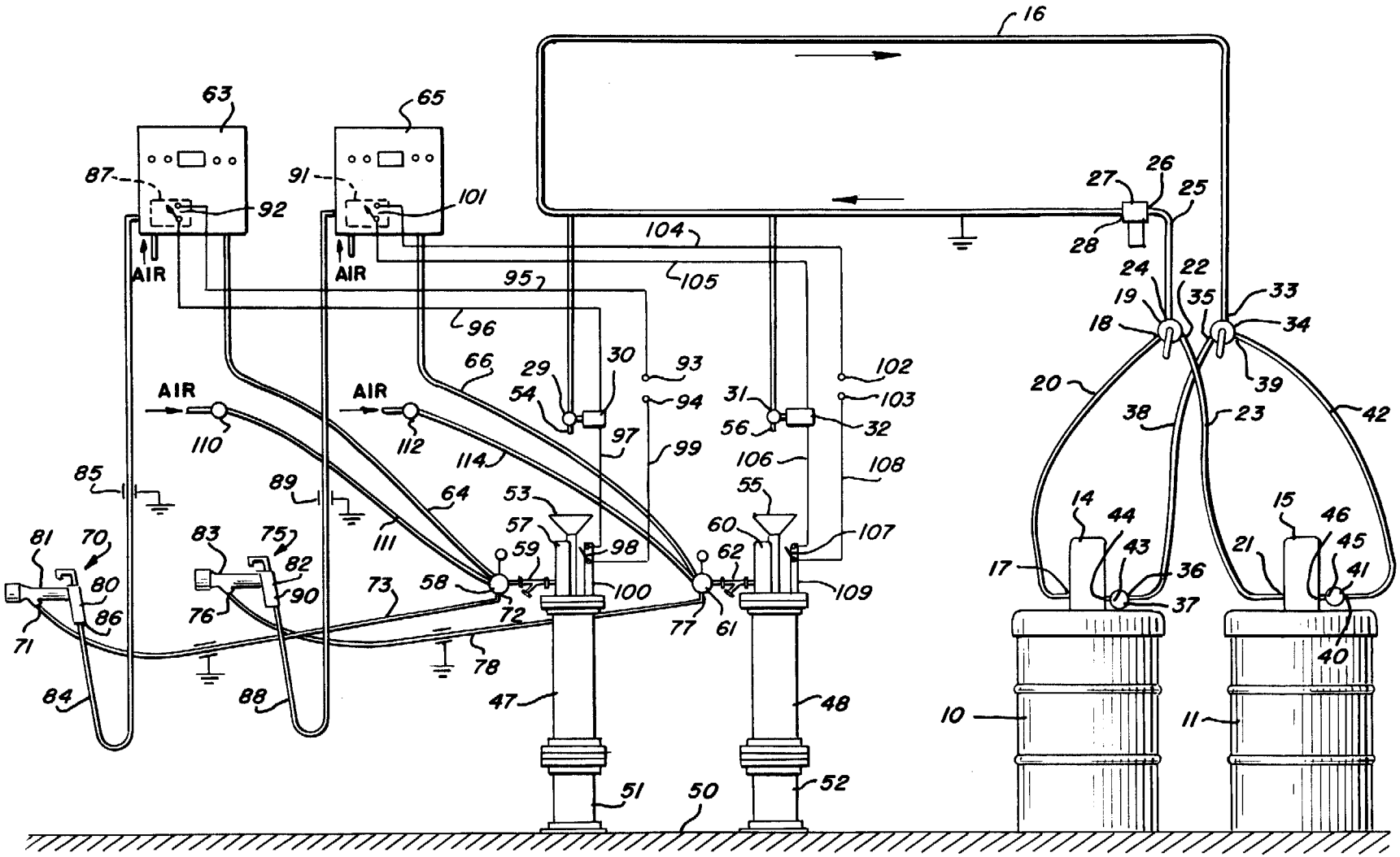
AIR
AIR
AIR
AIR

VOLTAGE BLOCK ELECTROSTATIC COATING SYSTEM

BACKGROUND OF THE INVENTION

1. Field Of The Invention

The present invention relates to electrostatic spray coating systems and more particularly to electrostatic spray coating systems for applying conductive coatings such as water base paints.

2. Description Of The Prior Art

In the past years the applicant of the invention herein described designed and placed on the market automatic electrostatic spray coating systems for spraying highly conductive coatings such as porcelain enamel frit in a water carrier wherein the entire spray coating system including the entire supply system was electrically isolated from ground.

Such a system is disclosed in U.S. Pat. No. 3,463,121 issued Aug. 26, 1969, U.S. Pat. No. 3,621,815 issued Nov. 23, 1971 and U.S. Pat. No. 3,637,420 issued Jan. 25, 1972. Although such a system advanced the art, it could not have its main coating material supply reservoir filled while the high voltage was being applied to the system and it could not be utilized for manual spray systems for the operator would be touching components charged to the high voltage utilized in such systems.

Voltage blocks have been developed which consist of a main supply source of first container which is used to fill a second container. A third container at high voltage receives conductive coating material from the second container at times when no material is flowing from the first to the second container. These systems have the disadvantage that arcing will occur if insulated conduit is used between the first and second containers because of residual material on the conduit surfaces. Pouring from a transportation drum or container, as the grounded first container eliminates this arcing, but there still remains three required sub-systems which are the first at ground, the second or intermediate alternately at ground or high voltage, and the third at high voltage. Further, these three container or three sub-system supply systems can not be utilized for manual electrostatic spray systems for the operator would be touching components charged to high voltage.

SUMMARY OF THE INVENTION

The present invention overcomes these difficulties by providing an electrostatic spray coating system wherein the main supply reservoir may be filled while spraying is being carried out with the high voltage being applied. Several electrostatic guns can be used with a single grounded paint supply system. The electrostatic spray gun may be handled and operated manually to effect manual electrostatic spray coating of highly conductive materials. The supply system consists of only two conductive coating supply sub-systems wherein the first is grounded and the second is subjected to high voltage. Material is transferred from the first system to the second system across an air space only when the high voltage is turned off. When the high voltage is turned on, the air space prevents any portion of the high voltage system or of the conductive coating material contained therein from shorting to any portion of the grounded sub-system or any conductive coating material contained therein.

It is therefore an object of the present invention to provide a new and improved electrostatic spray coating system for spraying highly conductive coating material.

A further object is to provide an electrostatic spray coating system which has two coating supply sub-systems separated from each other by an air space with interlocks which permit transfer of conductive coating material from one supply sub-system to the second supply sub-system only when high voltage is not being applied to the second high voltage sub-system.

Still another object is to provide a manually operated electrostatic spray coating system for spraying highly conductive coating materials which has a grounded main reservoir supply and a high voltage supply which receives highly conductive material from the main reservoir without the necessity of having an intervening container system which is alternately at high volatge or grounded.

DESCRIPTION OF THE DRAWINGS

Further objects and advantages will become apparent from the following detailed description taken in connection with the accompanying schematic drawing of an electrostatic spray coating system embodying the present invention.

DESCRIPTION OF THE PREFERRED EMBODIMENT

While this invention is susceptible of embodiment in many different forms, there will be described herein in detail, an embodiment of the invention with the understanding that the present disclosure is to be considered as an exemplification of the principles of the invention and is not intended to limit the invention to the embodiment illustrated. The scope of the invention will be pointed out in the appended claims.

Referring now to the drawings, two 55 gallon paint drums 10 and 11 contain water based paint. The paint drums are fitted with pumps 14 and 15 respectively to pump paint from the drums to a paint circulating line 16. The pumps which are mounted to the tops of the two 55 gallon cans may be one of any of the various types well known to those skilled in the art. Pump 14 has a discharge port 17 which is connected to an intake port 18 of a three-way valve 19 by a flexible paint line 20. A discharge port 21 of pump 15 is connected to a second input port 22 of three-way valve 19 by a flexible paint line 23. A discharge port 24 of three-way valve 19 is connected to an input port 26 of a filter 27 by a paint line 25. An output port 29 of the filter 27 is connected to the aint circulating line 16. The line 16 is connected to input port 29 of a solenoid valve 30, to an input port 31 of a solenoid valve 32 and to an input port 33 of a three-way valve 34. A discharge port 35 of the three-way valve 34 is connected to an input port 36 of a back pressure regulator 37 by a flexible paint line 38. A second output port 39 of the three-way valve 33 is connected to an input port 40 of a back pressure regulator 41 by a flexible paint line 42. An output port 43 of the back pressure regulator 36 is connected directly to an input port 44 of the pump 14 and a discharge port 45 is connected directly to an input port 46 of the pump 15. The components thus far described in detail constitute an electrically grounded paint supply sub-system. This grounded sub-system together with the high voltage supply sub-system to be presently described in detail constitute the complete coating supply system.

A pair of paint tanks 47 and 48 are mounted on electrically insulated supports 51 and 52 respectively which are secured to a building floor 50. The tanks 47 and 48 may be of any convenient size, as for example 2 gallon capacity tanks. A funnel 53 is mounted on the tank 47 and positioned to receive coating material from a discharge port 54 of the solenoid valve 30. Whenever the valve is open the funnel 53 discharges directly into the tank 47. Similarly the funnel 55 is mounted on the tank 48 and positioned to receive coating material from a discharge port 56 of solenoid valve 32 whenever the valve is open, and funnel 55 discharges directly into tank 48. A pump 57 is mounted on the tank 47 to pump fluid from the tank to a remote controlled variable pressure regulator 58 through a paint strainer 59, and a pump 60 is mounted on the tank 48 to pump paint under pressure from that tank to a remote controlled variable pressure regulator 61 through a paint strainer 62. A high voltage power supply 63 is connected to paint regulator 58 by a high voltage conductor 64, and a high voltage power supply 65 is connected to paint regulator 61 by a high voltage conductor 66. The high voltage power supplies may be of any conventional design well known to those skilled in the art, but are preferably of the immediate voltage dropoff type. The respective power supply 63 and 65 are therefore capable of placing the paint in the tanks 47 and 48 together with their associated pumps, funnels, strainers and regulators at voltages of 60,000 volts or more.

An air atomizing electrostatic spray gun generally indicated as 70 has an input coating material port 71 connected to an output port 72 of the remote control variable fluid pressure regulator 58 by an insulated fluid hose 73 which has a grounded conductive shield layer. An air atomizing spray gun 75 has a coating material input port 76 connected to an output port 77 of the remote controlled variable pressure regulator 61 by a fluid hose 78 having a conductive shield layer. The spray guns 70 and 75 may be of either of the grounded handle types illustrated and described in U.S. Pat. No. 3,774,844, issued Nov. 27, 1973, or U.S. Pat. No. 3,746,253, issued July 17, 1973. The fluid hoses 73 and 78 may be of the insulator layer-conductive shield type fully described in U.S. Pat. No. 3,774,844 or it may be of the insulator layer-conductive shield covering layer type illustrated and disclosed in U.S. Pat. No. 3,746,253.

The spray guns have rounded metal handles 80 and 82 respectively and have insulated forward ends 81 and 83 respectively. As aforementioned these guns may be either the type illustrated and disclosed in U.S. Pat. No. 3,774,844 or in U.S. Pat. No. 3,746,253. An air supply hose 84 has a conductive shield layer 85 and connects an air intake port 86 in the base of the handle to an air flow switch 87 mounted inside power supply 63. An air hose 88 has a conductive shield layer 89 and connects an air input port 90 in the base of the handle of the gun 75 to an air switch 91 mounted in the high voltage power supply 65. Thus the handles of the guns 70 and 75, the conductive shields of the air hoses 85 and 88, and the conductive shields of the high voltage cables 73 and 78 are all grounded in any suitable manner well known to those skilled in the art, but they are insulated from the high voltage potential placed in the high voltage fluid supply sub-system. The air flow switch 87 actuates two pairs of contacts. The first pair of contacts (not shown) places high voltage on a cable 64 and thereby the fluid tank 47. The second set of contacts 92 are opened by air flowing through the air flow switch 87. A pair of terminals 93 and 94 are connected to a source of electrical potential (not shown). Serially connected between the terminals 93 and 94 are a lead 95, the switch contacts 92, a lead 96, an actuating solenoid coil of the solenoid 30, a lead 97, switch contacts 98, and a lead 99. The switch contacts 98 are actuated by a liquid level sensing device 100 mounted through the top of the tank 47. The liquid level sensing device 100 may be of any conventional type well known to those skilled in the art. The switch 98 is electrically isolated from the tank and the fluid in the tank. Similarly the air flow switch 91 has the first pair of switch contacts (not shown) which are utilized to place the high voltage on the high voltage cable 66 and thereby the fluid in tank 48. Air flow switch 91 has the second set of contacts 101 which are closed whenever air is not flowing to the gun 75. A pair of terminals 102 and 103 are connected across a source of electrical potential (not shown). Serially connected between terminals 102 and 103 is a lead 104, the switch contacts 101, a lead 105, an actuating coil in solenoid 32, a lead 106, a switch 107, and a lead 108. The switch 107 is mounted on and connected to be actuated by a liquid sennsing device 109 mounted through the top of tank 48 for the purpose of closing the contacts when the level of the liquid in the tank 48 drops below a predetermined level.

A precision air regulator 110 and air flow switch 87 are both connected to a source of high pressure air (not shown) which may be of any conventional design well known to those skilled in the art. The precision air regulator 110 is manually operated and is connected by a nylon air hose 111 to set paint pressure regulator 58 in any manner well known in the art. Similarly the precision air regulator 112 and the switch 91 are connected to a source of high pressure air (not shown). The air pressure regulator 112 is connected by a nylon hose 114 to paint pressure regulator 61 to set the pressure of the paint being pumped from tank 48 to gun 75. Thus essentially a two station manual spray gun system is illustrated. The operation of gun 70 will be described in detail with the understanding that gun 75 and its associated high voltage coating material supply sub-system operates in an identical manner.

The drum 10 is positioned and the pump 14 is mounted thereon as shown in the drawing. Similarly drum 11 is positioned and pump 15 is mounted thereon. Three-way valve 19 and 34 are then positioned to connect pump 14 with the paint circulating line 16 so that when pump 14 is energized, coating material will be pumped from drum 10 through the circulating line 16 returning to the pump through back pressure regulator 36. When drum 10 is empty the three-way valve 19 and 34 are positioned to disconnect drum 10 from the paint circulating line 16 and to connect drum 11. Drum 10 can then be removed and replaced with a full drum.

With the grounded paint supply sub-system pressurized, the full system is ready for operation. An operator then may pick up spray gun 70 and release its trigger (not shown) which prevents air from flowing through air line 84 and gun 70 to atomize paint. The lack of air flow through air switch 87 closes switch contacts 92. If tank 47 is empty or if the coating material in tank 47 is below a predetermined level, the level sensing device 100 will close switch 98. This completes the electrical circuit between terminals 93 and 94 energizing the coil of solenoid valve 30 to open it. A stream of coating material is then directed downwardly into funnel 53 to fill the tank 47 until it is approximately filled. At this predetermined level the sensing device 100 opens the switch 98 to de-energize and close the solenoid valve 30 stopping the flow of coating material to funnel 53. When the trigger of the gun 70 is pulled thereby opening the contacts 92 of air flow switch 87, and closing the high voltage contacts (not shown) in power supply 63, high voltage from power supply 63 is applied to the material in tank 48 through the line 64. Since the coating material is highly conductive, high voltage is carried through the coating material in line 73 into the head of the gun 70. As is more fully described in the aforementioned U.S. Pat. Nos. 2,774,844 and 3,746,253, the air atomizes the coating material and, since the high voltage is transmitted to the atomizing point through the cable 64 and the highly conductive coating material in the line 73, the atomizing material may provide the high voltage electrode which is directed at the grounded work to be coated. Since switch contacts 92 are open as long as air is flowing to the spray gun 70, the solenoid valve 30 cannot be opened while the trigger of the gun is depressed. However, as soon as the operator stops spraying by releasing the trigger of gun 70, contacts 92 are then closed allowing the actuation and opening of solenoid valve 30 if the level in the tank has dropped below the low predetermined level and contacts 98 have been closed by sensing device 100. The distance between the solenoid valve 31 and the top of the funnel 53 may be of any convenient length which will prevent any possible sparking therebetween, a suitable distance for a 60,000 volt system being 12 inches. Since the handle of the gun 70, the shield of the air hose 85, the sield of the fluid insulated hose 73, and the precision air regulator are all grounded and isolated from the high voltage supply sub-system, the operator and the grounded coating material supply sub-system are fully protected from contact with the high voltage components of this system including material in tank 47 and flowing through the hose 73.

Many modifications of the inventions may be made by those skilled in the art without departing from the principles of the invention. For example, the paint drums 10 and 11 could be replaced by any other suitable major reservoir such as movable or stationary tanks. The number of reservoirs could be increased by merely adding more pumps and more multiple positioned valving in the grounded supply sub-system. Likewise the number of spray gun stations and high voltage-sub-systems could be increased in number as required for a particular installation. Further, the air gun 70 and 75 could be replaced by hydrostatic atomizing guns, centrifugal force atomizing guns, electrostatic atomizing guns, or a combination thereof by providing a different control system for turning off the high voltage power supplies and operating the solenoid valves when the triggers of such guns are released. Further, the manual guns could be replaced by automatic electrostatic spray painting guns and mounted on reciprocators as is well known in the art.

I claim:

1. In an electrostatic coating system having a spray gun for ejecting highly electrically conductive coating material and an electrode charge to high voltage adjacent the location of ejection of the coating material from the spray gun having a high voltage power supply, and having a coating material supply system supplying coating material to the gun, wherein the improvement comprises, a first sub-system in said coating material supply system containing coating material electrically grounded, a second sub-system in said coating material supply system containing coating material insulated from electrical ground and connected to said high voltage power supply, means for ejecting a stream of coating material into the atmosphere forming a portion of said first sub-system, means for receiving said stream of coating material as it is ejected across a predetermined air space forming a portion of said second sub-system, said air space having a sufficiently large predetermined dimension between said first and second means to prevent arcing in said air space when said second system is charged to a high voltage by said high voltage power supply, and control means connected to said ejecting means to prevent ejection of said stream when said high voltage power supply is charging said second sub-system to a high voltage.

2. An electrostatic coating system as specified in claim 1, wherein said ejecting means is located directly above said means for receiving said stream of coating material whereby the force of gravity is utilized to transfer coating material from first sub-system to said second sub-system.

3. An electrostatic coating system as specified in claim 1, wherein said second sub-system includes means for sensing said electrode is being charged to high voltage by said high voltage power supply connected to said ejecting means.

4. An electrostatic coating system as specified in claim 1, wherein control means includes sensing means for determining said second sub-system is being charged to high voltage connected to said ejecting means.

5. An electrostatic coating system as specified in claim 1, wherein said control means comprises, a manually operated trigger mounted on said spray gun, an air valve connected to be operated by said trigger, a flexible air line connected to said air valve, an air flow switch connected to said flexible air hose, and said means for ejecting a stream of coating material into the atmosphere comprising a solenoid operated valve electrically connected for activation to said air flow switch.

6. A coating material supply system for supplying coating material to a spray coating gun comprising, first container means for retaining coating material at a first electrical potential, control means for propelling a stream of coating material across an air space connected to said first container means, means for receiving said propelled stream from said air space, and second container means for maintaining coating material at a second electrical potential when said control means is preventing said stream from flowing connected to said receiving means.

7. In combination with the coating material supply system specified in claim 6, means for sensing said second container means and coating material therein is charged to said second electrical potential connected to said control means.

8. In combination with the material supply system specified in claim 6, a sensing means for determining high voltage is being applied to said spray coating gun connected to said control means.

9. A coating material supply system as specified in claim 6, wherein said second container means for maintaining coating material at a second electrical potential includes interlocking means between said spray gun and said control means.

10. An electrostatic coating system as specified in claim 6, wherein said ejecting means is located directly above said means for receiving said stream of coating material whereby the force of gravity is utilized to transfer coating material from first sub-system to said second sub-system.

* * * * *